US012123116B2

(12) United States Patent
Ranzenigo et al.

(10) Patent No.: US 12,123,116 B2
(45) Date of Patent: Oct. 22, 2024

(54) CIRCULAR KNITTING MACHINE WITH AN OFFSET SYSTEM FOR THE STITCH CAM OF THE NEEDLE PLATE

(71) Applicant: SANTONI S.P.A., Brescia (IT)

(72) Inventors: Roberto Ranzenigo, Brescia (IT); Fabio Bonetti, Brescia (IT); Andrea Lonati, Brescia (IT)

(73) Assignee: SANTONI S.P.A., Brescia (IT)

( * ) Notice: Subject to any disclaimer, the term of this patent is extended or adjusted under 35 U.S.C. 154(b) by 0 days.

(21) Appl. No.: 17/619,577

(22) PCT Filed: Jun. 15, 2020

(86) PCT No.: PCT/IB2020/055559

§ 371 (c)(1),
(2) Date: Dec. 15, 2021

(87) PCT Pub. No.: WO2020/254933

PCT Pub. Date: Dec. 24, 2020

(65) Prior Publication Data

US 2022/0325450 A1 Oct. 13, 2022

(30) Foreign Application Priority Data

Jun. 17, 2019 (IT) ..... 102019000009216

(51) Int. Cl.
*D04B 15/32* (2006.01)
*D04B 15/34* (2006.01)

(52) U.S. Cl.
CPC ..... *D04B 15/322* (2013.01); *D04B 15/34* (2013.01)

(58) Field of Classification Search
CPC ..... D04B 15/322; D04B 15/34; D04B 15/18; D04B 9/065

(Continued)

(56) References Cited

U.S. PATENT DOCUMENTS 439,050 A * 10/1890 Bugbee ..... D04B 9/06 66/21
461,508 A * 10/1891 Sanders ..... D04B 1/10 66/142

(Continued)

FOREIGN PATENT DOCUMENTS

EP 1055756 A2 11/2000
EP 1469111 A1 * 10/2004 ..... B65B 11/52

(Continued)

OTHER PUBLICATIONS

Search Report dated Aug. 20, 2020 in corresponding International Application No. PCT/IB2020/055559, 5 pages.

(Continued)

*Primary Examiner* — Grace Huang
(74) *Attorney, Agent, or Firm* — MH2 TECHNOLOGY LAW GROUP LLP

(57) ABSTRACT

A circular knitting machine for knitted items, comprising: a supporting structure; a needle-holding cylinder selectively turnable and provided with a plurality of cylinder needles; and a dial assembly. The dial assembly includes a supporting ring integral with the supporting structure; a needle-holding plate turnably mounted to the supporting ring; a plurality of plate needles; a plurality of control cams which interact with the plate needles to transmit to them a radial movement inside the respective sliding seat, wherein the control cams globally form a cam profile. The dial assembly includes a stitch cam placed movably on the supporting ring and interacting with the plate needles in a given angular sector during the rotation of the needle-holding plate, so as to transmit to the plate needles a motion of return for executing stitch formation. The stitch cam is selectively movable with respect to the cam profile.

16 Claims, 4 Drawing Sheets

(58) Field of Classification Search
USPC ..... 66/27, 59
See application file for complete search history.

(56) References Cited

U.S. PATENT DOCUMENTS 641,837 A * 1/1900 Burleigh ..... D04B 9/06 66/24
1,148,055 A * 7/1915 Scott ..... D04B 9/22 66/111
1,152,850 A * 9/1915 Scott ..... D04B 15/665 66/49
1,215,411 A * 2/1917 Rice ..... D04B 9/06 66/145 R
1,273,802 A * 7/1918 Aiken ..... D04B 15/14 66/8
1,282,880 A * 10/1918 Gable ..... D04B 9/06 66/107
1,533,446 A * 4/1925 Murphy ..... D04B 15/08 66/111
1,575,932 A * 3/1926 Perry ..... D04B 15/32 66/24
1,695,734 A * 12/1928 Lamontagne ..... D04B 1/26 66/236
1,702,839 A * 2/1929 Perry ..... D04B 9/06 66/57
1,853,783 A * 4/1932 Smith, Jr. ..... D04B 9/06 66/111
1,865,710 A * 7/1932 Smith, Jr. ..... D04B 9/46 66/134
2,106,872 A * 2/1938 Henry ..... D04B 9/06 66/24
2,129,148 A * 9/1938 Page ..... D04B 9/06 66/25
2,255,068 A * 9/1941 Cloutier ..... D04B 9/06 66/26
2,399,002 A * 4/1946 Benjamin ..... D04B 15/34 66/24
2,705,410 A * 4/1955 Zeruneith ..... D04B 15/327 66/26
2,714,298 A * 8/1955 Crawford ..... D04B 9/06 66/111
2,968,170 A * 1/1961 Wiesinger ..... H01H 15/105 66/38
3,241,337 A * 3/1966 Stevens, Jr. ..... D04B 9/12 66/93
3,422,638 A * 1/1969 Goadby ..... D04B 9/06 66/131
3,452,559 A * 7/1969 Horst ..... D04B 9/06 66/131
3,535,892 A * 10/1970 Gerhard ..... D04B 15/78 66/57
3,560,359 A * 2/1971 Martinetz ..... C23F 13/04 204/196.05
3,595,032 A * 7/1971 Reagan ..... D04B 15/06 66/107
3,603,116 A * 9/1971 Turini ..... D04B 1/108 66/49
3,605,445 A * 9/1971 Philip ..... D04B 15/32 66/20
3,681,941 A * 8/1972 Burdett ..... D04B 9/26 66/131
3,832,867 A * 9/1974 Luchi ..... D04B 9/32 66/13
3,869,879 A * 3/1975 Brunner ..... D04B 15/327 66/54
3,877,256 A * 4/1975 Roque ..... D04B 15/34 66/24
3,895,489 A * 7/1975 Waller ..... D04B 23/08 66/203
4,041,734 A * 8/1977 Yoichi ..... D04B 15/14 66/115
4,109,490 A * 8/1978 Bosch ..... D04B 35/06 66/120
4,147,042 A * 4/1979 Bourgeois ..... D04B 15/68 66/241
4,188,804 A * 2/1980 Hoffmann ..... D04B 15/34 66/51
4,328,685 A * 5/1982 Smith ..... D04B 15/42 242/131
4,502,300 A * 3/1985 Schimko ..... D04B 15/327 66/77
5,186,028 A * 2/1993 Kawase ..... D04B 15/99 66/232
5,251,462 A * 10/1993 Shima ..... D04B 15/365 66/77
5,526,655 A * 6/1996 Lida ..... D04B 15/34 66/57
6,151,921 A * 11/2000 Plath ..... D04B 15/94 66/57
6,182,477 B1 * 2/2001 Shibata ..... D04B 15/99 66/232
6,907,758 B2 * 6/2005 Traenkle ..... D04B 9/06 66/125 R
7,552,602 B2 * 6/2009 Knight, Sr. ..... D04B 9/065 66/194
8,726,699 B2 * 5/2014 Lonati ..... D04B 15/68 66/19
10,233,574 B2 * 3/2019 Wan ..... D04B 15/88
2016/0258087 A1 * 9/2016 Lonati ..... D04B 15/94
2022/0243370 A1 * 8/2022 Ranzenigo ..... D04B 15/82

FOREIGN PATENT DOCUMENTS

GB 324725 A * 1/1930 ..... D04B 9/06
GB 378946 A * 8/1932 ..... D04B 9/06
GB 1329486 A 9/1973

OTHER PUBLICATIONS

Written Opinion dated Aug. 20, 2020 in corresponding International Application No. PCT/IB2020/055559, 13 pages.

* cited by examiner

CIRCULAR KNITTING MACHINE WITH AN OFFSET SYSTEM FOR THE STITCH CAM OF THE NEEDLE PLATE

CROSS-REFERENCE TO RELATED APPLICATIONS

This application is a U.S. National Stage application of PCT/IB2020/055559 filed Jun. 15, 2020, pending, which claims priority to Italian Application No. 102019000009216 filed Jun. 17, 2019, the entire disclosures of which are hereby incorporated by reference.

BACKGROUND

The present invention relates to a circular knitting machine. In particular, the invention relates to a circular knitting machine for hosiery or knitted items, provided with a system enabling to cause an offset of a stitch cam acting upon the needles of the plate.

The present invention falls into the technical field of circular knitting machines for hosiery items, knitted items, seamless knitted items, and the like.

In the present text the wording "knitting machine" generally means a circular knitting machines apt to manufacture knitted items and provided with at least one needle-holding unit or needle-holding cylinder turnably mounted in a supporting structure of the machine and supporting in suitable sliding seats (or needle seats) a plurality of needles moving parallel to an axis of rotation of the needle-holding cylinder so as to produce a knitted fabric.

Moreover, the knitting machine is provided with one or more yarn feeding points or yarn "feeds", in which the needles of the machine are supplied with yarn. Circular knitting machines can comprise a variable number of feeds, e.g. 1, 2, 4, 6, 8 or more yarn feeds.

This knitting machine can be e.g. single or double needlebed.

Specifically, the present invention is designed in particular, though not exclusively, for circular knitting machines comprising, in addition to the aforesaid needle cylinder, also a needle plate, i.e. a unit which is again turnably mounted to the supporting structure of the machine and supporting in respective suitable sliding compartments (or needle seats) a plurality of respective needles (known as plate needles).

The needle plate is located above the needle cylinder and coaxial thereto: this means that the cylinder and the plate rotate both around the same axis of rotation. The plate needles are movable in their respective seats on a plane orthogonal to the aforesaid axis of rotation and along radial directions with respect to the axis of rotation, with a translational motion getting towards and away from the axis of rotation.

The plate needles cooperate with the cylinder needles during stitch formation. Typically, cylinder and plate are positioned so that the heads of the cylinder needles, which are movable in vertical direction, intersect with the heads of the plate needles, which are movable in horizontal direction, during the rotation of the cylinder and of the plate, based on the movements transmitted by the control means (cams, selecting units, etc.) of the needles. Using the jargon of knitting machines for hosiery items, this type of machine is known as "single-cylinder" circular knitting machine "with needles in plate", i.e. a knitting machine equipped with a needle-holding cylinder and with a plate provided with its additional needles, which cooperate with the cylinder needles during stitch formation, thus allowing to obtain particular knitted structures. The plate needles therefore support the cylinder needles and this machine is similar to a double-needlebed machine (since needles are both on the cylinder and on the plate).

In this type of knitting machines, the number of plate needles is typically smaller than cylinder needles. For instance, the number of plate needles can be half the number of cylinder needles, a plate needle being placed between two adjacent cylinder needles.

In the present text, the working "dial assembly" means the portion of the knitting machine placed above the needle-holding cylinder and supporting the aforesaid needle plate. This assembly is provided with units and devices apt to cooperate with the plate needles and with the yarns in the feeds so as to enable the production of knitted fabric.

In the field of circular knitting machines, several modes for making the dial assembly and the devices connected thereto are known. In general, the dial assembly is typically equipped with a stationary supporting ring, with a yarn conveying and cutting unit (referred to in the field as "yarn trimming saw") mounted outside to the supporting ring so as to be able to rotate around the latter, and with a plurality of pneumatic devices positioned on the supporting ring.

This plurality of pneumatic devices usually comprises at least one needle control assembly, provided with one or more control cams, which are able to interact with the plate needles, and a plurality of clip assemblies, e.g. whose number corresponds to the number of machine feeds; each clip assembly comprises one or more movable clips, which are able to retain or block a yarn supplied to the needles of the knitting machine, and pneumatic actuators moving said clips.

The dial assembly can further comprise cutting devices, or "yarn trimming knives", each one equipped with a cutting unit, which is able to cooperate with the aforesaid saw and cut the yarns carried by the saw itself. Moreover, the dial assembly can comprise yarn sucking devices, or "yarn sucking ports", which suck the yarns or more of more feeds and their down.

Basically, the dial assembly comprises inside a group of several devices, some of them being repeated as a module for each feed and others being shared by more feeds or present individually.

The dial assembly further comprises the aforesaid needle plate, supporting its respective plurality of needles. This plate is mounted to the supporting ring so as to be able to turn around an axis of rotation coinciding with the axis of rotation of the needle-holding cylinder. The aforesaid saw is further integral with the plate and rotates with it.

The aforesaid control cams interact with the plate needles so as to transmit to the latter, during the rotation of the plate, a radial movement inside the respective seat, getting towards or away from the axis of rotation, based on a given law of motion defined by the cam profile. Thus the plate needles are moved at will so that they interacts as desired with the cylinder needles during stitch formation.

Globally, the control cams define a "circular" cam profile, i.e. developing as a ring around the axis of rotation, which the control butts of the plate needle interact sequentially with.

Typically, the dial assembly comprises a specific cam, known as stitch cam, whose task is to "retract" the plate needles inside the plate, i.e. towards the axis of rotation, during stitch formation. This stitch cam acts upon the plate needles and has a given angular extension around the axis of rotation, so as to engage a given portion of the needle rotation trajectory.

In knitting machines as the ones described above, the plate needles should work in specific positions with respect to the underlying cylinder needles: in particular, the plate needles can work exactly in phase (i.e. in perfect synchronism) with respective cylinder needles, so as to obtain a more elastic fabric, or they can work out of phase with respect to the cylinder needles, i.e. with an angular delay, so as to obtain a more compact fabric. This angular offset basically consists in a "delay" of the plate needle with respect to the underlying cylinder needle, and is obtained by an angular shift, e.g. of some degrees, of the stitch cam controlling the motion of return of the plate needles. Thus the yarn is not absorbed by cylinder and plate needles at the same time, but it is absorbed first by cylinder needles and then, with an angular delay e.g. of one or two needles, by plate needles.

A prior art solution consists in shifting the stitch cam angularly, between two positions, by means of a pneumatic drive. The two positions correspond to a synchronous condition between plate and cylinder needles and to a condition of delay of plate needles with respect to cylinder needles, respectively. In this solution, the pneumatic drive, when controlling the transition between the two positions, causes a shift of the stitch cam and, with it, of the aforesaid devices on the dial assembly, i.e. yarn sucking ports, clips, yarn trimming knives, as well as of the control cams defining the cam profile (i.e. the other cams in the plate in addition to the stitch cam).

This represents a huge drawback since the other control cams on the dial assembly, in addition to the stitch cam, should actually work in a precise position and cannot be shifted due to the need for stitch cam offset. Let us consider for instance cams for stitch transfer (transfer cams): these cams do not work correctly when the stitch cam is shifted in a delayed position between plate and cylinder needles, therefore, in prior art solutions, should these cams be used, the pneumatic drive should first move all the devices back to the synchronous position. This involves the impossibility to use some cams, e.g. transfer cams, while the stitch cam is in an offset position, i.e. in a delayed position. This is a limitation to the knitting functions that can be obtained with the knitting machine.

Moreover, the prior art solutions consists only in moving the stitch cam, by means of the drive, between the two positions, synchronous and delay.

Generally, the Applicant has found that prior art solutions are not without drawbacks and can be improved under various aspects.

Under these circumstances, the aim underlying the present invention in its various aspects and/or embodiments is to provide a circular knitting machine which can obviate one or more of the drawbacks referred to above.

A further aim of the present invention is to provide a circular knitting machine in which the position of the stitch cam of the dial assembly can be managed in a more flexible manner, for controlling plate needles.

A further aim of the present invention is to provide a circular knitting machine in which the stitch cam of the needle plate can be moved irrespective of the operations performed at the same time by the other devices of the dial assembly.

A further aim of the present invention is to provide a circular knitting machine in which, under the different operating conditions and based on knitting requirements, yarn sucking can be managed with more accuracy during stitch formation on the needle cylinder and on the needle plate.

A further aim of the present invention is to provide a circular knitting machine which enables to optimize knitting quality, e.g. by aligning knitted rows produced by plate needles with respect to knitted rows produced by cylinder needles.

A further aim of the present invention is to provide a circular knitting machine characterized by a high operating reliability and/or by a lower susceptibility to failures and malfunctions.

A further aim of the present invention is to provide a circular knitting machine characterized by a simple and rational structure, in particular of its dial assembly.

A further aim of the present invention is to provide a circular knitting machine which increases the possibilities of defining the knitted structures that can be obtained, depending on the various knitting requirements and on the laws of motion to be transmitted to the needles, in particular to plate needles.

A further aim of the present invention is to provide a circular knitting machine characterized by low manufacturing costs as far as offered performance and quality are concerned.

A further aim of the present invention is to create alternative solutions to the prior art for carrying out circular knitting machines, and/or to open new design possibilities.

A further aim of the present invention is to provide a circular knitting machine which can enable a new design of the devices in the dial assembly.

A further aim of the present invention is to provide a circular knitting machine characterized by an innovative structure and configuration with respect to the state of the art.

These and other possible aims, which shall appear better from the following description, are basically achieved by a circular knitting machine according to one or more of the appended claims, each one being considered alone (without those depending on it) or in any combination with the other claims, and according to the following aspects and/or embodiments, variously combined, also with the aforesaid claims.

In the present invention and in the appended claims, the terms "upper", "above", "lower", "below", "vertical", "vertically", "horizontal", "horizontally", "radial", "radially", refer to the positioning of the machine during normal operation, with the central axis of rotation placed vertically, the cylinder needles arranged vertically with their heads pointing upwards, and the plate needles arranged horizontally with their heads pointing outside the needle-holding plate.

SUMMARY

Some aspects of the invention are listed below.

In a first aspect thereof, the invention relates to a circular knitting machine for knitted or hosiery items, comprising:

- a supporting structure;
- at least one needle-holding cylinder turnably mounted in said supporting structure and selectively turnable around an axis of rotation of the knitting machine;
- a plurality of cylinder needles supported by said needle-holding cylinder and movable in respective sliding seats of the cylinder so as to produce a knitted fabric;
- a dial assembly arranged above said needle-holding cylinder.

In one aspect, the dial assembly comprises:

a supporting ring integral with said supporting structure and preferably coaxial with said needle-holding cylinder;

a needle-holding plate turnably mounted to said supporting ring so as to be able to turn around a respective axis of rotation corresponding to said axis of rotation of the knitting machine;

a plurality of plate needles supported by said needle-holding plate and movable in respective sliding seats of the plate so as to produce a knitted fabric.

In one aspect, the dial assembly comprises a yarn conveying and cutting unit, or "saw", mounted outside to said supporting ring and integral with said needle-holding plate, so as to rotate with the needle-holding plate.

In one aspect, the dial assembly comprises a plurality of cams controlling the plate needles, placed on said supporting ring and configured for interacting with the plate needles and transmit to them, during the rotation of the plate, a radial movement inside the respective sliding seat, approaching or away from the axis of rotation, based on a given law of motion, wherein said control cams globally form a cam profile developing around the axis of rotation, with which the plate needles interact sequentially, said cam profile defining said given law of motion.

In one aspect, the dial assembly comprises at least one stitch cam, separate and distinct from said plurality of cams controlling the plate needles, placed movably on said supporting ring and configured for interacting with the plate needles in a given angular sector during the rotation of the needle-holding plate around said axis of rotation, said stitch cam being configured for transmitting to the plate needles a return motion, approaching the axis of rotation, in a given angular position so as to execute stitch formation.

In one aspect, the stitch cam is selectively movable with respect to said cam profile.

In one aspect, the stitch cam can be moved (or driven) while said plurality of cams for controlling the plate needles is kept still (with respect to the supporting ring).

The Applicant has found out that the invention enables to solve the problems listed above related to the prior art and thus to obtain the intended aims.

In particular, the Applicant has found out that the invention enables a more flexible and independent management of the position of the stitch cam of the dial assembly, for controlling the plate needles, and in particular enables an offset of the angular position of the plate needles with respect to the angular position of the cylinder needles.

Further aspects of the invention are listed below.

In one aspect, the dial assembly comprises a moving device operatively acting upon said stitch cam so as to move said stitch cam along a circular trajectory, around said axis of rotation, between at least one operating position, in which the stitch cam has a first angular position with respect to the axis of rotation, and a second operating position, in which the stitch cam has a second angular position angularly rotated with respect to said first angular position, along said circular trajectory.

In one aspect, said moving device only acts upon said at least one stitch cam, and wherein the movement of said at least one stitch cam between said first operating position and second operating position occurs by keeping the same position of said plurality of cams controlling the plate needles and of said cam profile.

In one aspect, the stitch cam, independently movable with respect the cam profile, and the moving device globally form an offset system for the stitch cam of the needle plate.

In one aspect, the knitting machine comprises means of rotation, configured for selectively causing a rotation of the needle-holding cylinder around said axis of rotation, and means for transmitting rotation, housed in or associated to said supporting structure and operatively placed between said needle-holding cylinder and said dial assembly configured for synchronously transmitting a rotation, generated by said means of rotation, to said needle-holding cylinder and said needle-holding plate, so that the same rotation of the needle-holding plate corresponds to a given rotation of the needle-holding cylinder.

In one aspect, the moving device operatively acts upon the stitch cam so as to move it at least between:

a synchronous position, in which the stitch cam causes a movement of the needles of the plate during stitch formation, which is basically synchronous with the movement of the underlying needles of the cylinder, during the rotation of the needle-holding cylinder and of the needle-holding plate, so that the plate needles make a stitch simultaneously with the cylinder needles; and/or a delayed position, which is angularly behind with respect to the synchronous position, with respect to the direction of rotation of the cylinder and of the needle-holding plate, in which the stitch cam causes a movement of the needles of the plate during stitch formation, which is angularly delayed with respect to the movement of the underlying needles of the cylinder, during the rotation of the needle-holding cylinder and of the needle-holding plate, so that the needles of the plate make a delayed stitch in cooperation with the needles of the cylinder; and/or an advanced position, which is angularly before with respect to the synchronous position, with respect to the direction of rotation of the cylinder and of the needle-holding plate, in which the stitch cam causes a movement of the needles of the plate during stitch formation, which is angularly advanced with respect to the movement of the underlying needles of the cylinder, during the rotation of the needle-holding cylinder and of the needle-holding plate, so that the needles of the plate make an advanced stitch in cooperation with the needles of the cylinder.

In one aspect, the delayed position and the advanced position are positions in which the stitch cam causes an offset of the plate needles with respect to the cylinder needles.

In one aspect, the synchronous position corresponds to said first operating position and the delayed or advanced position corresponds to said second operating position.

In one aspect, the advanced position corresponds to said first operating position and the delayed position corresponds to said second operating position, the synchronous position resulting from a third intermediate operating position between said first and said second operating position.

In one aspect, said first and said second angular position are end angular position that can reached by the stitch cam in its movement along said circular trajectory thanks to said moving device.

In one aspect, said circular trajectory basically corresponds to an arc of circle whose center lies on the axis of rotation and with a given angular extension.

In one aspect, the movement of the stitch cam takes place around the axis of rotation.

In one aspect, the moving device operatively acts upon the stitch cam so as to move it selectively and continuously among a plurality of operating positions, each one being characterized by a given angular positioning of the stitch cam with respect to the axis of rotation, along said circular trajectory, and wherein the variation of the angular position of the stitch cam occurs continuously among successive adjacent positions.

In one aspect, the stitch cam can be moved continuously among the plurality of operating positions so as to introduce an incremental offset on the working trajectories of the plate needles with respect to the working trajectories of the cylinder needles.

In one aspect, the moving device operatively acts upon the stitch cam so as to move it selectively between a discrete number of operating positions, each one being characterized by a given angular positioning of the stitch cam with respect to the axis of rotation, along said circular trajectory.

In one aspect, the dial assembly comprises one or more of the following additional devices, preferably mounted to said supporting ring:

- one or more clip assemblies, each one comprising one or more movable clips, configured for retaining or blocking a yarn supplied to the needles of the knitting machine, and actuators, preferably pneumatic actuators, moving said clips;
- one or more cutting devices, or "yarn trimming knives", each one equipped with a cutting unit configured for cooperating with said saw and cut the yarns carried by the saw itself;
- one or more yarn sucking devices, or "yarn sucking ports", configured for sucking the yarns or more of more feeds and their down.

In one aspect, said stitch cam is independently movable with respect to said additional devices, the movement of the stitch cam occurring without causing a movement of said additional devices.

In one aspect, said additional devices of the dial assembly are still in a stationary position with the knitting machine in use.

In one aspect, said cam profile defined by said plurality of cams controlling the plate needles develops around the axis of rotation in a continuous manner, so as to form a ring-shaped cam profile, or it is divided into several separate lengths or portions.

In one aspect, the stitch cam has a given angular extension around the axis of rotation, so as to engage a given portion of the needle rotation trajectory.

In one aspect, said moving device is positioned, or in general integral with, said supporting ring of the dial assembly.

In one aspect, the moving device comprises a motor which operatively acts upon said stitch cam so as to selectively move it between the aforesaid operating positions. In one aspect, said motor is an electric motor, by way of example a stepper motor.

In one aspect, the moving device comprises a mechanical drive placed between said motor and said stitch cam, so as to transmit the motion of the motor to the stitch cam.

In one aspect, the moving device comprises a plate at least provided with:

- a mounting fulcrum through which the plate is turnably mounted to said supporting ring coaxially to said axis of rotation;
- a fastening portion designed to receive the stitch cam so as to support and position it in said operating positions;
- a control portion configured for receiving a motion from said motor, so as to cause a rotation of the plate around the axis of rotation and a movement of said fastening portion, carrying the stitch cam, along the aforesaid circular trajectory.

In one aspect, the plate is operatively placed between said stitch cam and said motor.

In one aspect, the control portion comprises a toothed sector.

In one aspect, the moving device comprises a drive shaft coupled with the motor so as to receive from it a rotary motion and ending at a final end thereof with a toothed gear engaged with said toothed sector of the control portion, so as to transmit the rotary motion of the drive shaft to the plate.

In one aspect, the stitch cam is in contact, in addition to the plate needles, with said plate only.

In one aspect, the control portion is placed in the plate in a diametrically opposed position with respect to the fastening portion of the stitch cam.

In one aspect, said motor can be a pneumatic motor.

In one aspect, said toothed sector has such an extension (width) as to enable a width of angular rotation of the plate that can position the stitch cam in all of the aforesaid operating positions.

In one aspect, the width of angular rotation of the stitch cam is of at least 2°, and/or of at least 4°, and/or of at least 8°, and/or of at least 12°, and/or of at least 20°, and/or of at least 40°.

In one aspect, the width of angular rotation of the plate corresponds to the width of angular rotation of the stitch cam.

In one aspect, each of the plate needles comprises a respective actuating butt, and the stitch cam defines at least one stitch cam profile configured for being engaged and got through by the butts of the plate needles in sequence, during plate rotation, so that a given motion is transmitted to the plate needles in their respective sliding seats.

In one aspect, the stitch cam consists of one or more portions of stitch cam, defining between them, globally, said stitch cam profile.

In one aspect, said portions of stitch cam are fastened to said fastening portion of the plate in respective positions.

In one aspect, said portions of stitch cam can be distinct from each other or integral with each other in one stitch cam body.

In one aspect, the stitch cam is fastened to the fastening portion of the plate by suitable fastening means, e.g. screws.

In one aspect, the needle-holding cylinder comprises at least one respective stitch cam, configured for interacting with the cylinder needles in a given angular sector during the rotation of the needle-holding cylinder around the axis of rotation, said stitch cam being configured for transmitting to the cylinder needles a return motion, into the respective needle seat, in a given angular position so as to execute stitch formation.

In one aspect, the knitting machine comprises a control unit configured for interacting with the moving device of the dial assembly and with the device moving the stitch cam of the needle-holding cylinder, so as to:

- receive a first position signal from the motor acting upon the stitch cam of the needle-holding plate, said first position signal being related to the position of the plate stitch cam;
- receive a second position signal from the motor acting upon the stitch cam of the needle-holding cylinder, said second position signal being related to the position of the cylinder stitch cam;
- optionally, compare the first and second position signal, related to the position of the plate stitch cam and to the cylinder stitch cam, with respective reference values corresponding to desired positions of the plate stitch cam and of the cylinder stitch cam;

selectively control the motor acting upon the stitch cam of the needle-holding plate and the motor acting upon the stitch cam of the needle-holding cylinder so that the position of the plate stitch cam and the position of the cylinder stitch cam coincide the with respective reference values.

In one aspect, the aforesaid reference values correspond to reset positions of the motor acting upon the plate stitch cam and of the motor acting upon the cylinder stitch cam.

In one aspect, the control unit is configured for programming and/or maintaining a given offset between the position of the stitch cam of the needle-holding plate and the position of the stitch cam of the needle-holding cylinder, based on the position signals of the motor acting upon the plate stitch cam and of the motor acting upon the cylinder stitch cam, and suitably controlling the position of both motors.

In one aspect, the control unit is configured for making a feedback check of the positions of the plate stitch cam and of the cylinder stitch cam by changing in a dynamic and continuous manner the position of the motor acting upon the plate stitch cam and the position of the motor acting upon the cylinder stitch cam based on the position signals of both motors, so as to maintain a mutual positioning between the plate stitch cam and the cylinder stitch cam.

In one aspect, the moving device comprises at least one proximity sensor placed in the dial assembly and configured for detecting the presence or absence of a reference element placed on said stitch cam or on said plate carrying the stitch cam, in a given reference position.

In one aspect, said reference position of the reference element is selected so that the position taken by the stitch cam when the proximity sensor detects the presence of the reference element corresponds to a given condition of mutual positioning between the stitch cam of the needle-holding plate and the stitch cam of the needle-holding cylinder.

In one aspect, the position taken by the stitch cam in said given condition of mutual positioning between the plate stitch cam and the cylinder stitch cam can correspond to the aforesaid synchronous position, or to the aforesaid advanced position, or to said delayed position, or to a different operating position of the plate stitch cam.

In one aspect, the position taken by the stitch cam in said given condition of mutual positioning between the plate stitch cam and the cylinder stitch cam is a default position, e.g. designed to be reached at the end of a fabric manufacturing step of the knitting machine.

In one aspect, said control unit is configured for executing a calibration of the motor acting upon the stitch cam, by executing the following operations:

moving, by means of said moving device, the stitch cam until the proximity sensor detects the presence of said reference element (i.e. as far as said default position);

verify whether the deviation between the value of said first position signal of the motor acting upon the plate stitch cam and a default value (corresponding to reference absolute zero for the motor) falls within an acceptable tolerance interval for considering the motor positioning as correct;

possibly, actuate the motor acting upon the stitch cam of the needle-holding plate so as to reset or minimize said deviation between the value of said first position signal and said default value.

In one aspect, the control unit is configured for executing an automatic check of the calibration of the motor acting upon the stitch cam, resetting at every stitch formation cycle or as a result of calibration command the position of the motor acting upon the plate stitch cam so that there is no deviation between the value of the first position signal and said default value.

In one aspect, the knitting machine comprises a plurality of feeds or yarn feeding points on which the yarn is supplied to the machine needles, the feeds being positioned circumferentially around the component-holding unit and angularly spaced from each other.

In one independent aspect thereof, the present invention relates to a moving device according to one or more of the aforesaid aspects and/or claims, designed to be installed in a dial assembly of a circular knitting machine for knitted or hosiery items.

Each one of the aforesaid aspects of the invention can be considered alone or in combination with any one of the claims or of the other aspects as described.

BRIEF DESCRIPTION OF THE DRAWINGS

Further characteristics and advantages shall be more evident from the detailed description of some embodiments, among which also a preferred embodiment, which are exemplary though not exclusive, of a circular knitting machine according to the present invention. This description shall be made below with reference to the accompanying drawings, provided to a merely indicative and therefore non-limiting purpose, in which:

in FIG. 1 the stitch cam of the dial assembly is in a first operating position;

in FIG. 3 the stitch cam of the dial assembly is in a second operating position;

With reference to the mentioned figures, the numeral 1 globally designates a circular knitting machine according to the present invention. Generally, the same numeral is used for identical or similar elements, if applicable in their variants of embodiment.

FIG. 1 shows a possible embodiment of a knitting machine according to the present invention, with some parts being removed. In particular, the figure is focused on the dial assembly and on the needle-holding cylinder, so as to make it easier to understand the present invention.

DETAILED DESCRIPTION

Figure 1:
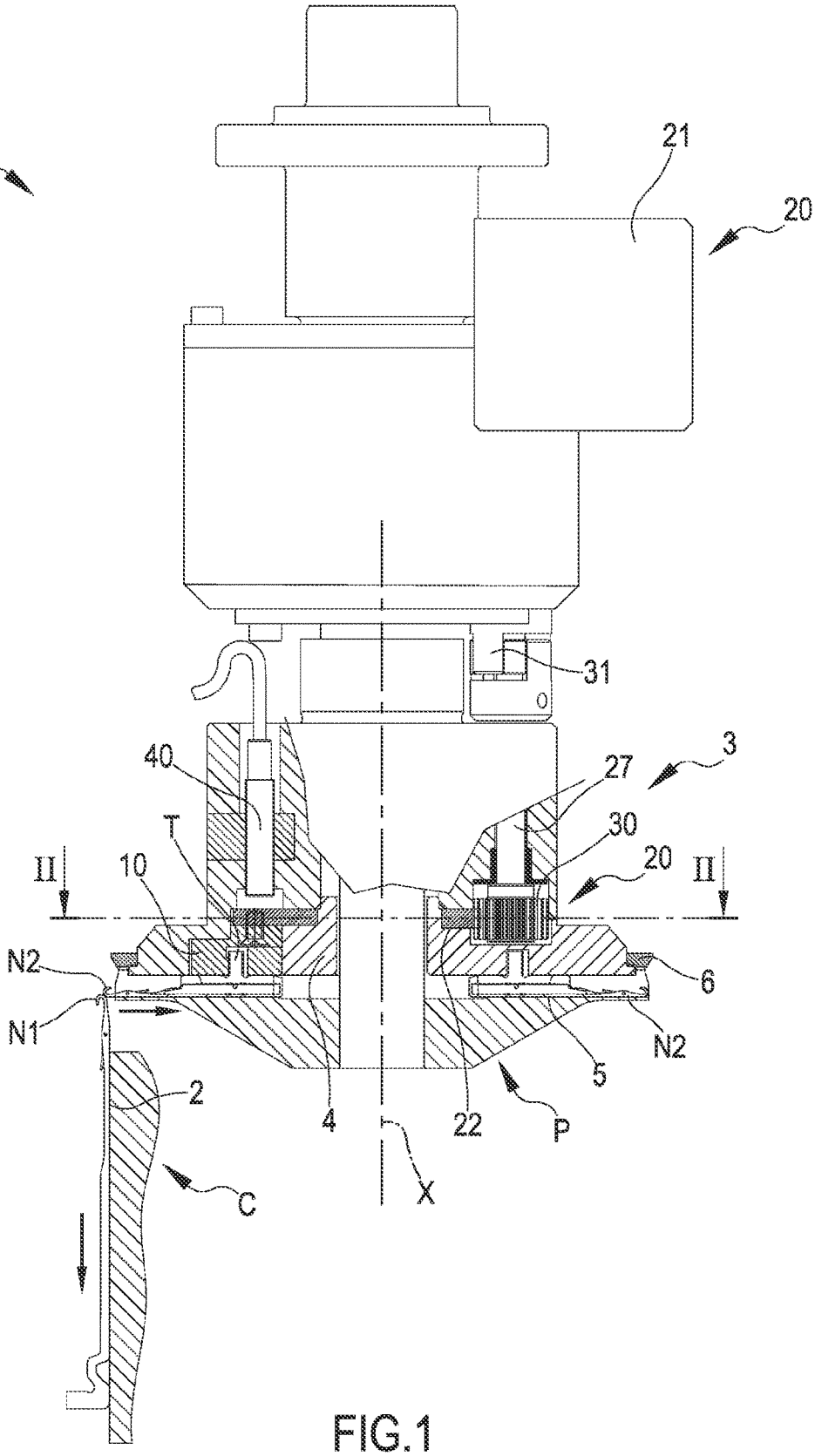
FIG. 1 shows a view of a possible embodiment of a circular knitting machine according to the present invention, with some parts being removed and partially sectioned (along a vertical plane through the axis of rotation of the needle-holding cylinder and of the needle-holding plate); in particular, the dial assembly with the needle plate, and the underlying needle-holding cylinder (partially) are shown.

The basement of the knitting machine, the section including the processing unit, further components of the knitting head and of the needle-holding cylinder, its means for generating and transmitting rotation to the needle-holding cylinder and plate, and other parts of the knitting machine, are not shown in detail in the figures, since they are known per se and of conventional type. From the point of view of knitting technology, the operation of the whole knitting machine (e.g. the operation of the needle-holding cylinder, the cooperation between needles and yarns, etc.) is not described in detail since it are known in the technical field of the present invention.

The knitting machine 1 comprises a supporting structure, a needle-holding cylinder C turnably mounted in the supporting structure and selectively turnable around an axis of rotation X of the knitting machine, and a plurality of cylinder needles N1 supported by the needle-holding cylinder and movable in respective sliding seats 2 of the cylinder so as to produce a knitted fabric.

The knitting machine 1 further comprises a dial assembly 3 arranged above the needle-holding cylinder C.

The dial assembly 3 comprises a supporting ring 4 integral with the supporting structure and coaxial with the needle-holding cylinder C; the supporting ring is a stationary frame of the dial assembly, which remains still with the knitting machine in use.

The dial assembly 3 comprises:

- a needle-holding plate P turnably mounted to the supporting ring 4 so as to be able to turn around a respective axis of rotation corresponding to the axis of rotation X of the knitting machine;
- a plurality of plate needles N2 supported by the needle-holding plate P and movable in respective sliding seats 5 of the plate P so as to produce a knitted fabric.

Preferably, the dial assembly 3 comprises a yarn conveying and cutting unit, or "saw" 6, mounted outside to the supporting ring 4 and integral with the needle-holding plate P, so as to rotate with the latter.

The dial assembly 3 comprises a plurality of cams controlling the plate needles N2, placed on the supporting ring 4 and configured for interacting with the plate needles and transmit to them, during the rotation of the plate, a radial movement inside the respective sliding seat 5, approaching or away from the axis of rotation X, based on a given law of motion. The control cams globally form a cam profile 7 developing around the axis of rotation X, with which the needles N2 of the plate P interact, and the cam profile 7 defines the aforesaid given law of motion.

The dial assembly further comprises at least one stitch cam 10, separate and distinct from the aforesaid plurality of cams controlling the plate needles N2, placed movably on said supporting ring 4 and configured for interacting with the plate needles N2 in a given angular sector during the rotation of the needle-holding plate around the axis of rotation X. The stitch cam 10 is configured for transmitting to the plate needles N2 a return motion, approaching the axis of rotation X, in a given angular position so as to execute stitch formation.

In accordance with the present invention, the stitch cam 10 is selectively movable with respect to the aforesaid cam profile 7. In other words, the stitch cam 10 can be moved, i.e. suitably driven for making a controlled motion, while the plurality of cams for controlling the needles N2 of the plate P is kept still with respect to the supporting ring 4.

To this purpose and in accordance with a preferred embodiment, the dial assembly 3 preferably comprises a moving device 20 operatively acting upon said stitch cam 10 so as to move it along a circular trajectory, around the axis of rotation X, between at least one operating position, in which the stitch cam 10 has a first angular position with respect to the axis of rotation, and a second operating position, in which the stitch cam 10 has a second angular position angularly rotated with respect to the first angular position, along the aforesaid circular trajectory.

Preferably, the moving device 20 only acts upon the stitch cam 10, and the movement of the stitch cam between the first operating position and the second operating position occurs by keeping the same position of said plurality of cams controlling the needles N2 of the plate P and therefore of the cam profile 7.

The stitch cam 10, independently movable with respect the cam profile 7, and the moving device 20 globally form an offset system for the stitch cam of the needle plate P.

Preferably, the knitting machine 1 comprises means of rotation (not shown, e.g. of known type), configured for selectively causing a rotation of the needle-holding cylinder P around the axis of rotation X, and means for transmitting rotation, housed in or associated to said supporting structure and operatively placed between the needle-holding cylinder C and the dial assembly 3 configured for synchronously transmitting a rotation, generated by said means of rotation, to the needle-holding cylinder C and the needle-holding plate P, so that the same rotation of the needle-holding plate P corresponds to a given rotation of the needle-holding cylinder C.

Preferably, the moving device 20 operatively acts upon the stitch cam 10 so as to move it at least between:

- a synchronous position, in which the stitch cam 10 causes a movement of the needles N2 of the plate P during stitch formation, which is basically synchronous with the movement of the underlying needles N1 of the cylinder C, during the rotation of the needle-holding cylinder C and of the needle-holding plate P, so that the plate needles make a stitch simultaneously with the cylinder needles;
- a delayed position, which is angularly behind with respect to the synchronous position, with respect to the direction of rotation of the cylinder C and of the needle-holding plate P, in which the stitch cam 10 causes a movement of the needles N2 of the plate P during stitch formation, which is angularly delayed with respect to the movement of the underlying needles N1 of the cylinder C, during the rotation of the needle-holding cylinder and of the needle-holding plate, so that the needles N2 of the plate P make a delayed stitch in cooperation with the needles N1 of the cylinder C;
- an advanced position, which is angularly before with respect to the synchronous position, with respect to the direction of rotation of the cylinder C and of the needle-holding plate P, in which the stitch cam 10 causes a movement of the needles N2 of the plate P during stitch formation, which is angularly advanced with respect to the movement of the underlying needles N1 of the cylinder C, during the rotation of the needle-holding cylinder and of the needle-holding plate, so that the needles N2 of the plate P make an advanced stitch in cooperation with the needles N1 of the cylinder C.

Figure 3:
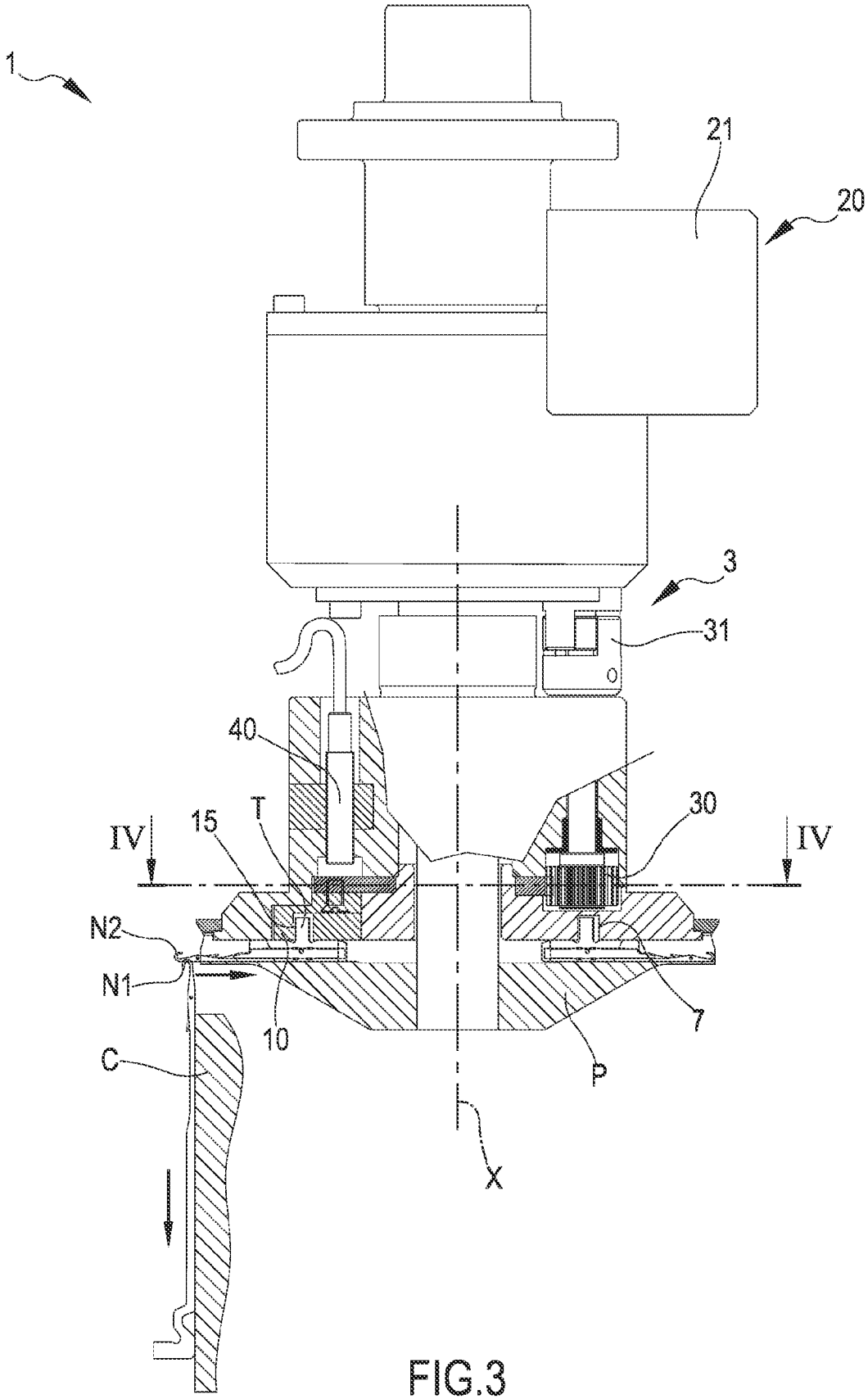
FIG. 3 shows a view of the circular knitting machine of FIG. 1, with some parts being removed and partially sectioned.
Figure 4:
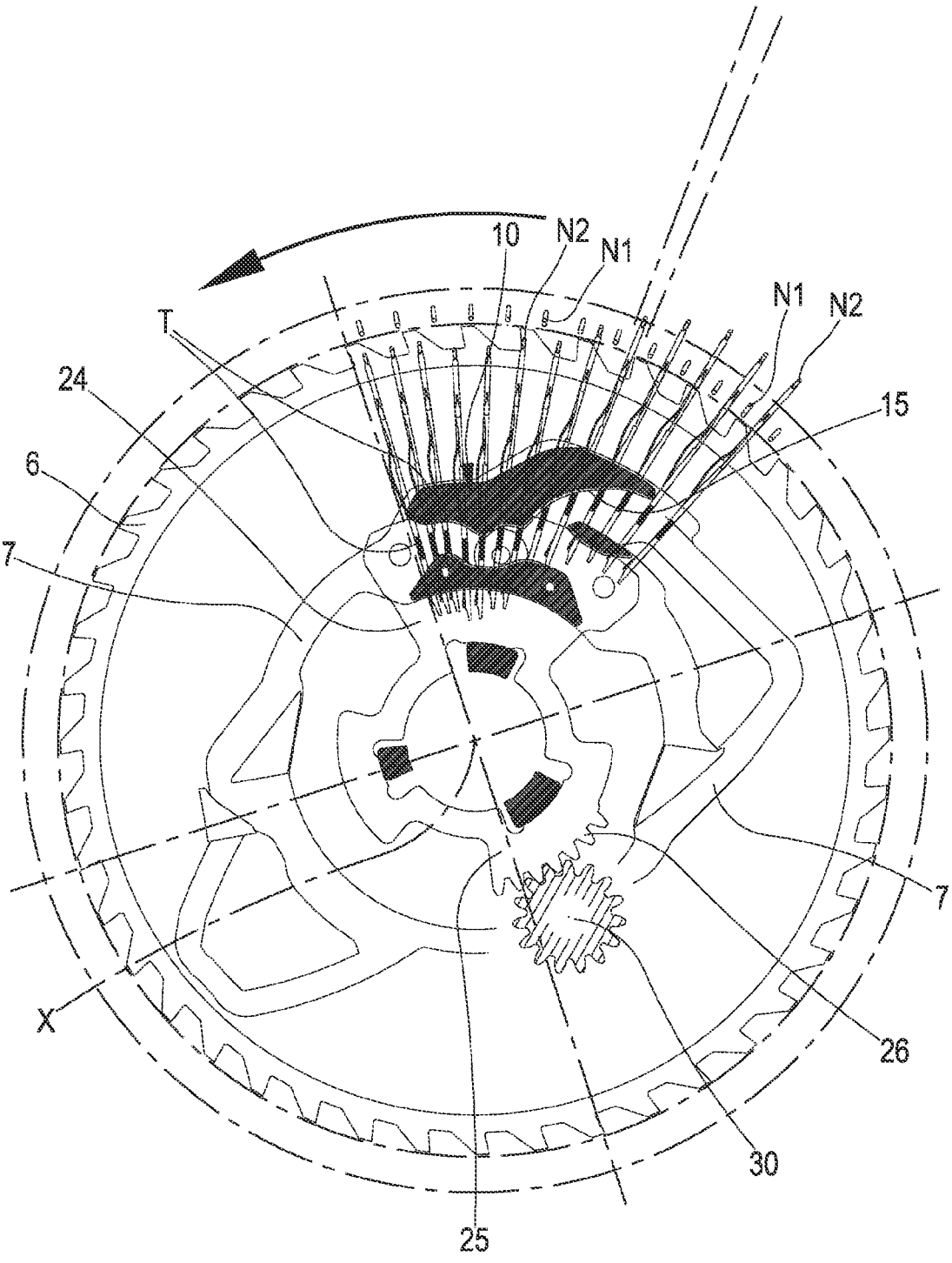
FIG. 4 is a plan view from above of a portion of the knitting machine as in FIG. 3, with some parts being removed, the cam path, the stitch cam, some plate needles and a part of the moving device for the stitch cam (according to said second operating position) are shown; the arrow indicates the direction of the rotation of the needle-holding cylinder and of the needle-holding plate.

It should be pointed out that position of the stitch cam behind the synchronous position means that the stitch cam is shifted along the direction of rotation of the plate so as to interact with the plate needles in a delayed manner with respect to what occurs in the synchronous position (FIGS. 3 and 4).

It should be pointed out that position of the stitch cam before the synchronous position means that the stitch cam is shifted along the direction of rotation of the plate so as to interact with the plate needles in advance with respect to what occurs in the synchronous position.

Preferably, the delayed position and the advanced position are positions in which the stitch cam 10 causes an offset, during stitch formation, of the needles N2 of the plate P with respect to the needles N1 of the cylinder C.

Figure 2:
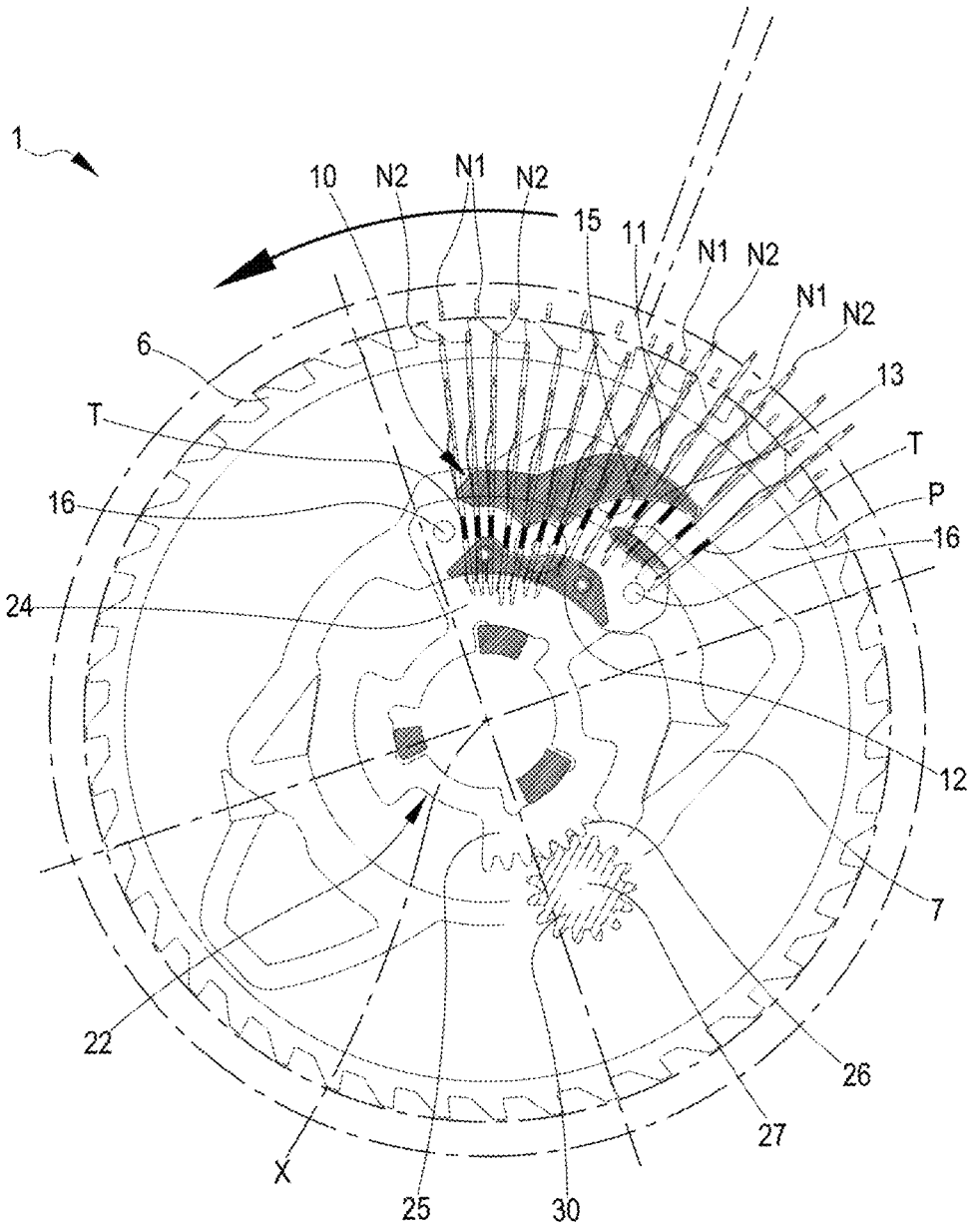
FIG. 2 is a plan view from above of a portion of the knitting machine of FIG. 1, with some parts being removed, the cam path, the stitch cam, some plate needles and a part of the moving device for the stitch cam (according to said first operating position) are shown; the arrow indicates the direction of the rotation of the needle-holding cylinder and of the needle-holding plate.

FIGS. 1 and 2 show the circular knitting machine 1 with the stitch cam 10 in the aforesaid synchronous position: in FIG. 2 the angular position of the stitch cam 10 makes the plate needles N2 make the motion of return into their respective sliding seats 5 in such a position as to make a stitch at the same time as the needles N1 of the underlying cylinder. This phasing can be seen in FIG. 1, which shows a needle N1 of the cylinder C and a needle N2 of the plate P that are synchronous to one another so as to obtain a compact knitted fabric. FIGS. 3 and 4 show the circular knitting machine 1 with the stitch cam 10 in the aforesaid delayed position: in FIG. 4 the angular position of the stitch cam 10 (behind with respect to the position of FIG. 2) makes the plate needles N2 make the motion of return into their respective sliding seats 5 in such a position as to make a stitch in a delayed manner with respect to the needles N1 of the underlying cylinder. This offset can be seen in FIG. 3, which shows a needle N1 of the cylinder C and a needle N2 of the plate P that are mutually offset so as to obtain a more compact knitted fabric.

Preferably, the synchronous position (FIGS. 1 and 2) corresponds to said first operating position and the delayed position (FIGS. 3 and 4) corresponds to said second operating position.

As an alternative, the synchronous position corresponds to the first operating position and the advanced position (not shown) corresponds to the second operating position.

According to a possible embodiment, the advanced position corresponds to the first operating position and the delayed position corresponds to the second operating position, the synchronous position resulting from a third intermediate operating position between the first and the second operating position.

In general, the aforesaid first and the aforesaid second angular position can be end angular positions that can reached by the stitch cam 10 in its movement along the circular trajectory thanks to the moving device 20. Preferably, the circular trajectory of the stitch cam basically corresponds to an arc of circle whose center lies on the axis of rotation X and with a given angular extension.

Preferably, as shown in the figures, the movement of the stitch cam 10 takes place around the axis of rotation X, i.e. it is centered with respect to the latter.

Preferably, the moving device 20 operatively acts upon the stitch cam 10 so as to move it selectively and continuously among a plurality of operating positions, each one being characterized by a given angular positioning of the stitch cam 10 with respect to the axis of rotation X, along said circular trajectory; preferably the variation of the angular position of the stitch cam occurs continuously among successive adjacent positions. Preferably, the stitch cam 10 can be moved continuously among the plurality of operating positions so as to introduce an incremental offset of the stitch formation position of the plate needles N2 with respect to the working trajectories of the cylinder needles N1.

In a possible embodiment, the moving device 20 operatively acts upon the stitch cam 10 so as to move it selectively between a discrete number of operating positions, each one being characterized by a given angular positioning of the stitch cam with respect to the axis of rotation, along said circular trajectory.

Preferably, the dial assembly 3 comprises one or more of the following additional devices, preferably mounted to the supporting ring 4:

- one or more clip assemblies, each one comprising one or more movable clips, configured for retaining or blocking a yarn supplied to the needles of the knitting machine, and actuators, preferably pneumatic actuators, moving said clips;
- one or more cutting devices, or "yarn trimming knives", each one equipped with a cutting unit configured for cooperating with said saw and cut the yarns carried by the saw itself;
- one or more yarn sucking devices, or "yarn sucking ports", configured for sucking the yarns or more of more feeds and their down.

Preferably, the stitch cam 10 is independently movable with respect to the aforesaid additional devices, i.e. the movement of the stitch cam 10 occurs without causing a movement of these additional devices.

Preferably, the additional devices of the dial assembly 3 are still in a stationary position with the knitting machine in use.

Preferably, the cam profile 7 defined by the aforesaid plurality of cams controlling the plate needles develops around the axis of rotation X in a continuous manner, so as to form a ring-shaped cam profile, or as an alternative, it can be divided into several separate lengths or portions.

Preferably, the sliding seats 2 of the cylinder C, housing the cylinder needles N1, are longitudinal grooves in the needle-holding cylinder, preferably parallel to the axis of rotation, and the sliding seats 5 of the plate P, housing the plate needles N2, are radial grooves in the needle-holding plate, centered on the axis of rotation X. Preferably, the needles N1 of the cylinder C are movable parallel to the axis of rotation X, i.e. vertically, and the needles N2 of the plate P are movable radially with respect to the axis of rotation X, i.e. horizontally.

Preferably, the stitch cam 10 has a given angular extension around the axis of rotation X, so as to engage a given portion of the rotation trajectory of the plate needles N2.

Preferably, the moving device 20 is integral with the supporting ring 4 of the dial assembly 3.

Preferably, the moving device 20 comprises a motor 21 which operatively acts upon the stitch cam 10 so as to selectively move it between the aforesaid operating positions. Preferably, this motor is an electric motor 21, by way of example a stepper motor.

Preferably, the moving device comprises a mechanical drive placed between said motor and said stitch cam, so as to transmit the motion of the motor to the stitch cam.

Preferably, as in the embodiment shown by way of example in the figures, the moving device 20 comprises a plate 22 equipped at least with:

- a mounting fulcrum through which the plate 22 is turnably mounted to the supporting ring 4 coaxially to the axis of rotation X;

a fastening portion 24 designed to receive the stitch cam 10 so as to support and position it in said operating positions;

a control portion 25 configured for receiving a motion from the motor 21, so as to cause a rotation of the plate 22 around the axis of rotation X and a movement of the fastening portion 24, carrying the stitch cam 10, along the aforesaid circular trajectory.

Preferably, the plate 22 is made as one piece. Preferably, the plate 22 is operatively placed between the stitch cam 10 and the motor 21.

Preferably, the control portion 25 comprises a toothed sector 26.

Preferably, the moving device 20 comprises a drive shaft 27 coupled with the motor 21 so as to receive from it a rotary motion and ending at a final end thereof with a toothed gear 30 engaged with the toothed sector 26 of the control portion 25, so as to transmit the rotary motion of the drive shaft 27 to the plate 22.

Preferably, the stitch cam 10 is in contact, in addition to the plate needles N2, with the plate 22 only.

Preferably, the control portion 25 is placed in the plate in a diametrically opposed position with respect to the fastening portion 24 carrying the stitch cam.

Preferably, an initial end of the drive shaft 27 is coupled to a shaft of said motor by means of a mechanical screw-worm wheel coupling, preferably placed at 90° one to the other.

In an embodiment, as shown by way of example in the figures, the drive shaft 27 comprises an upper axle shaft, comprising said initial end, and a lower axle shaft, comprising the aforesaid final end, connected to the other by means of a joint 31, e.g. an elastic joint, a stiff joint, a toothed joint, a grooved joint, a cardan joint, an Oldham joint, a bellows joint.

In a possible embodiment, the motor can be a pneumatic motor.

Preferably, the toothed sector 26 has such an extension (width) as to enable a width of angular rotation of the plate 22 that can position the stitch cam 10 in all of the aforesaid operating positions.

Preferably, the width of angular rotation of the stitch cam 10 is of at least 2°, and/or of at least 4°, and/or of at least 8°, and/or of at least 12°, and/or of at least 20°, and/or of at least 40°.

Preferably, the width of angular rotation of the plate 22 corresponds to the width of angular rotation of the stitch cam 10.

Preferably, as schematically shown in FIGS. 2 and 4, each of the needles N2 of the plate P comprises a respective actuating butt T, and the stitch cam 10 defines at least one stitch cam profile 15 configured for being engaged and got through by the butts T of the plate needles N2 in sequence, during the rotation of the plate P, so that a given motion is transmitted to the plate needles in their respective sliding seats 5.

Preferably, the stitch cam 10 consists of one or more portions of stitch cam (referred to with 11, 12 and 13), defining between them, globally, the aforesaid stitch cam profile 15.

The portions of stitch cam can be distinct from each other or integral with each other in one stitch cam body. The portions of stitch cam 10 can be fastened to the fastening portion 24 of the plate 22 so as to be in respective positions.

Preferably, the stitch cam 10 is fastened to the fastening portion 24 of the plate 22 by suitable fastening means, e.g., screws 16.

In a possible embodiment, the needle-holding cylinder C comprises at least one respective stitch cam, configured for interacting with the cylinder needles N1 in a given angular sector during the rotation of the needle-holding cylinder around the axis of rotation, said stitch cam being configured for transmitting to the cylinder needles a return motion, into the respective needle seat, in a given angular position so as to execute stitch formation.

Preferably, the needle holding cylinder C comprises a respective moving device, operatively acting upon the stitch cam of the cylinder so as to move it between at least one respective first operation position, in which the stitch cam of the cylinder takes a first position, with respect to the operating surface of the cylinder on which the sliding seats of the cylinder needles are defined, and one respective second operating position, in which the stitch cam of the cylinder takes a second position, with respect to the operating surface of the cylinder, which is different, as far as angle and/or height are concerned, from said respective first operating position.

Preferably, the device for moving the stitch cam of the needle-holding cylinder C comprises a respective motor, preferably an electric motor, operatively acting upon the stitch cam of the cylinder so as to selectively move it among the aforesaid operating positions. Preferably, the motor moving the stitch cam of the cylinder is a stepper motor.

Preferably, the knitting machine comprises a control unit (not shown, e.g., of known type) configured for interacting with the moving device 20 of the dial assembly 3 and with the device moving the stitch cam of the needle-holding cylinder C, so as to:

receive a first position signal from the motor 21 acting upon the stitch cam 10 of the needle-holding plate P, wherein this first position signal is related to the position of the plate stitch cam 10;

receive a second position signal from the motor acting upon the stitch cam of the needle-holding cylinder C, wherein this second position signal is related to the position of the cylinder stitch cam;

selectively control the motor 21 acting upon the stitch cam 10 of the needle-holding plate P and the motor acting upon the stitch cam of the needle-holding cylinder C so that the position of the plate stitch cam and the position of the cylinder stitch cam coincide with respective reference values.

Preferably, these reference values correspond to reset positions of the motor acting upon the plate stitch cam and of the motor acting upon the cylinder stitch cam.

Preferably, the control unit is configured for programming and/or maintaining a given offset between the position of the stitch cam 10 of the needle-holding plate P and the position of the stitch cam of the needle-holding cylinder C, based on the position signals of the motor 21 acting upon the plate stitch cam and of the motor acting upon the cylinder stitch cam, and suitably controlling the position of both motors.

Preferably, the control unit is configured for making a feedback check of the positions of the plate stitch cam and of the cylinder stitch cam by changing in a dynamic and continuous manner the position of the motor acting upon the plate stitch cam and the position of the motor acting upon the cylinder stitch cam based on the position signals of both motors, so as to maintain a mutual positioning between the plate stitch cam and the cylinder stitch cam.

In a possible embodiment, the knitting machine can comprise a cylinder lifting device, configured for axially moving the needle-holding cylinder. This movement introduces a variation to stitch formation on the cylinder, in the same manner as occurs as a result of the shift of the cylinder stitch cam by means of the aforesaid motor acting upon the latter.

Preferably, the control unit is configured for managing the feedback control of the desired position of the plate stitch cam also as a result of a variation of the position of the needle-holding cylinder due to the aforesaid cylinder lifting device. Preferably, the control unit modifies in a dynamic and continuous manner the position of the motor acting upon the plate stitch cam so as to maintain the mutual positioning between the plate stitch cam and of the cylinder stitch cam.

In a possible embodiment, as schematically shown in FIGS. 1 and 3, the moving device 20 comprises at least one proximity sensor 40 placed in the dial assembly 3 and configured for detecting the presence or absence of a reference element placed on the stitch cam 10 or on the plate 22 carrying the stitch cam, in a given reference position.

Preferably, said reference position of the reference element is selected so that the position taken by the stitch cam 10 when the proximity sensor 40 detects the presence of the reference element corresponds to a given condition of mutual positioning between the stitch cam of the needle-holding plate P and the stitch cam of the needle-holding cylinder C.

Preferably, the position taken by the stitch cam 10 in the given condition of mutual positioning between the plate stitch cam and the cylinder stitch cam can correspond to the aforesaid synchronous position, or to the aforesaid advanced position, or to the aforesaid delayed position, or to a different operating position of the plate stitch cam.

Preferably, the position taken by the stitch cam 10 in the given condition of mutual positioning between the plate stitch cam and the cylinder stitch cam can be a default position, e.g. designed to be reached at the end of a fabric manufacturing step of the knitting machine.

Preferably, the control unit is configured for executing, under given operating conditions or selectively upon command, a calibration of the motor 21 acting upon the stitch cam 10, by executing the following operations:

- moving, by means of the moving device 20, the stitch cam 10 until the proximity sensor 40 detects the presence of the reference element (i.e. as far as said default position);
- verify whether the deviation between the value of said first position signal of the motor acting upon the plate stitch cam and a default value (corresponding to reference absolute zero for the motor) falls within an acceptable tolerance interval for considering the motor positioning as correct;
- possibly, actuate the motor acting upon the stitch cam of the needle-holding plate so as to reset or minimize said deviation between the value of said first position signal and said default value.

Preferably, the control unit can be configured for executing an automatic check of the calibration of the motor 21 acting upon the stitch cam 10, resetting—at every stitch formation cycle or as a result of calibration command

- the position of the motor 21 acting upon the stitch cam 10 of the plate P so that there is no deviation between the value of the first position signal and said default value. Preferably, the reset takes place only if the deviation between the value of the first position signal and the default value falls within the tolerance interval.

Preferably, the proximity sensor 40 is integral with, or mounted to, said supporting ring 4.

Preferably, the proximity sensor 40 is placed in fixed position, under operating conditions of the knitting machine, with respect to the supporting ring 4 and to the supporting structure.

The proximity sensor 40 can be an inductive or capacitive or magnetic or ultrasonic or optical sensor.

The reference element can be a pin, mounted to the stitch cam 10 of the plate P or to the plate 22, or a notch or a graphical mark to be detected by the proximity sensor 40.

The invention thus conceived can be subjected to various changes and variants, all of which fall within the scope of the inventive idea, and the components mentioned here can be replaced by other technically equivalent element.

The present invention can be used both on new and on existing knitting machines, in the latter case replacing for instance some parts of the dial assembly.

The invention achieves important advantages both from a structural and a functional point of view. First of all, the invention allows to overcome at least some of the drawbacks of known technique.

Moreover, the invention allows to obtain a circular knitting machine in which the position of the stitch cam of the dial assembly can be managed independently from the additional devices and cams of the dial assembly. This means more flexibility in the use of plate needles, without the limitations affecting prior art solutions. Basically, the invention makes it possible to move the stitch cam of the needle plate irrespective of the operations performed at the same time by the additional devices of the dial assembly.

The present invention further allows to obtain a circular knitting machine which enables an accurate adjustment of the length of the knitted stitch as well as of the width of the stitch thus formed.

The invention further allows an accurate management, under the different operating conditions and based on knitting requirements, of yarn sucking during stitch formation on the needle cylinder and on the needle plate. In particular, it is possible to accurately select (among a plurality of operating positions, even in a continuous manner) the angular position of the stitch cam acting upon the plate needles, so that the position of the plate stitch cam is in phase, i.e. synchronous, or offset with respect to the position of stitch formation of the cylinder needles, based on the desired characteristics for the fabric being manufactured (i.e. compact or more or less soft/elastic fabric).

The position of the stitch cam of the dial assembly can be selected so as to make stitch formation synchronous or to introduce a desired and controlled offset.

For instance, it could be considered that in the circular knitting machines as described above the cylinder stitch cam can be lifted or lowered in order to adjust the length of the stitch thus formed; this movement of the cylinder stitch cam makes the impact between cylinder needle and stitch cam angularly shifted, which results in an offset, during stitch formation, of the cylinder needles with respect to the plate needles. The offset system (advance/delay) of the stitch cam of the dial assembly according to the present invention allows to retrieve and keep the phase between plate needles and cylinder needles constant even in case the height of the cylinder stitch cam is varied. The present invention allows to always coordinate the position of the plate stitch cam with the height of the cylinder stitch cam maintaining synchronism.

The technical solution of the present invention allows to maintain a constant yarn sucking (by moving in an independent and controlled manner the plate stitch cam) even in case the cylinder stitch cam is shifted; the movement of the plate stitch cam by means of the aforesaid moving device allows to compensate the shift on the cylinder.

The present invention allows to obtain a circular knitting machine which can manage the correct positioning of the motors acting upon the stitch cams, even in an automatic manner, and thus ensure a well-defined mutual positioning of the stitch cams both of the plate and of the cylinder, which can be in phase or offset, based on the desired textile features. It is thus possible to adjust fabric compactness or elasticity, control knitted fabric quality (e.g. the alignment of knitted rows produced by plate needles with knitted rows produced by cylinder needles) and adjust stitch length and fabric width.

The present invention further allows to obtain a circular knitting machine characterized by a simple and rational structure, in particular of its dial assembly, and characterized by low manufacturing costs as far as offered performance and quality are concerned.

The technical solution of the present invention further allows to increase the possibilities of defining knitted structured to be obtained with a circular knitting machine, based on the various knitting requirements.

The invention claimed is:

1. A circular knitting machine (1) for knitted items, comprising:

a supporting structure;

at least one needle-holding cylinder (C) turnably mounted in said supporting structure and selectively turnable around an axis of rotation (X) of the knitting machine;

a plurality of cylinder needles (N1) supported by said needle-holding cylinder (C) and movable in respective sliding seats (2) of the cylinder (C) so as to produce a knitted fabric of the knitted items;

a dial assembly (3) arranged above said needle-holding cylinder (C) and comprising:

a supporting ring (4) integral with said supporting structure and coaxial with said needle-holding cylinder (C);

a needle-holding plate (P) turnably mounted to said supporting ring (4) so as to be able to turn around a respective axis of rotation corresponding to said axis of rotation (X) of the knitting machine;

a plurality of plate needles (N2) supported by said needle-holding plate (P) and movable in respective sliding seats (5) of the plate (P) so as to produce the knitted fabric;

a plurality of cams controlling the plate needles (N2), placed on said supporting ring (4) and configured for interacting with the plate needles (N2) and transmitting to them, during the rotation of the plate (P), a radial movement inside the respective sliding seat (5), approaching or away from the axis of rotation (X), based on a given law of radial movement, wherein said control cams globally form a cam profile (7) developing around the axis of rotation (X), with which the plate needles (N2) interact sequentially, said cam profile (7) defining said given law of radial movement;

at least one stitch cam (10), separate and distinct from said plurality of cams controlling the plate needles (N2), placed movably on said supporting ring (4) and configured for interacting with the plate needles (N2) in a given angular sector during the rotation of the needle-holding plate (P) around said axis of rotation (X), said at least one stitch cam (10) being configured for transmitting to the plate needles (N2) a return motion, approaching the axis of rotation, in a determined angular position so as to execute stitch formation;

wherein the at least one stitch cam (10) is independently movable with respect to said cam profile (7), wherein the at least one stitch cam (10) can be moved while said plurality of cams controlling the plate needles (N2) is kept still with respect to the supporting ring.

2. The circular knitting machine (1) according to claim 1, wherein said cam profile (7) defined by said plurality of cams controlling the plate needles (N2) develops around the axis of rotation in a continuous manner, so as to form a ring-shaped cam profile, or said cam profile (7) is divided into several separate lengths or portions, and wherein the sliding seats (2) of the cylinder (C), housing the cylinder needles (N1), are longitudinal grooves in the needle-holding cylinder (C), parallel to the axis of rotation, and the sliding seats (5) of the plate (P), housing the plate needles (N2), are radial grooves in the needle-holding plate (P), centered on said axis of rotation (X), and wherein the cylinder needles (N1) are movable parallel to the axis of rotation (X), vertically, and the plate needles (N2) are movable radially with respect to the axis of rotation (X), horizontally.

3. The circular knitting machine (1) according to claim 1, wherein the dial assembly (3) comprises a moving device (20) operatively acting upon said at least one stitch cam (10) so as to move said at least one stitch cam (10) along a circular trajectory, around said axis of rotation (X), between at least a first operating position of a plurality of operating positions, in which the at least one stitch cam (10) has a first angular position with respect to the axis of rotation, and a second operating position of the plurality of operating positions, in which the at least one stitch cam (10) has a second angular position angularly rotated with respect to said first angular position, along said circular trajectory;

wherein said moving device (20) only acts upon said at least one stitch cam (10), and wherein the movement of said at least one stitch cam (10) between said first operating position and second operating position occurs by keeping the same position of said plurality of cams controlling the plate needles (N2) and of said cam profile (7), and wherein the at least one stitch cam (10), independently movable with respect to the cam profile (7), and the moving device (20) globally form an offset system for the at least one stitch cam (10) of the needle plate (P).

4. The circular knitting machine (1) according to claim 3, wherein said circular trajectory corresponds to an arc of circle whose center lies on the axis of rotation (X) and with a given angular extension.

5. The circular knitting machine (1) according to claim 3, wherein the dial assembly (3) comprises one or more of the following additional devices, mounted to said supporting ring:

one or more clip assemblies, each one comprising one or more movable clips, configured for retaining or blocking a yarn or yarns supplied to the plate needles (N2) of the knitting machine (1), and actuators, moving said clips;

one or more cutting devices, each one equipped with a cutting unit configured for cooperating with a saw and cut the yarn or yarns carried by the saw;

one or more yarn sucking devices, configured for sucking the yarn or yarns of one or more feeds and lint of the yarn or yarns, and wherein said at least one stitch cam (10) is independently movable with respect to said one or more additional devices, the movement of the at least one stitch cam (10) occurring without causing a movement of said one or more additional devices.

6. The circular knitting machine (1) according to claim 3, wherein the moving device (20) operatively acts upon the at least one stitch cam (10) so as to move the at least one stitch cam (10) selectively and continuously among the plurality of operating positions, each one being characterized by a determined angular positioning of the at least one stitch cam (10) with respect to the axis of rotation (X), along said circular trajectory, and wherein the variation of the angular position of the at least one stitch cam (10) occurs continuously among successive adjacent positions, and/or wherein the at least one stitch cam (10) can be moved continuously among the plurality of operating positions so as to introduce an incremental offset on working trajectories of the plate needles (N2) with respect to respective working trajectories of the cylinder needles (N1), and/or wherein the at least one stitch cam (10) has a given angular extension around the axis of rotation (X), so as to engage a give portion of a rotation trajectory of a needle of the plurality of plate needles (N2), and/or wherein a width of angular rotation of the at least one stitch cam (10) is of at least 2°, or of at least 3°, or of at least 12°, or of at least 20°.

7. The circular knitting machine (1) according to claim 3, wherein the moving device (20) operatively acts upon the at least one stitch cam (10) so as to move it at least between:

a synchronous operating position, in which the at least one stitch cam (10) causes a movement of the needles (N2) of the plate (P) during the stitch formation, which is synchronous with the movement of the underlying needles (N1) of the cylinder (C), during the rotation of the needle-holding cylinder (C) and of the needle-holding plate (P), so that the plate needles (N2) make a stitch simultaneously with the cylinder needles (N1); and a delayed operating position, which is angularly behind with respect to the synchronous operating position, with respect to the direction of rotation of the cylinder (C) and of the needle-holding plate (P), in which the at least one stitch cam (10) causes a movement of the needles (N2) of the plate (P) during the stitch formation, which is angularly delayed with respect to the movement of the underlying needles (N1) of the cylinder (C), during the rotation of the needle-holding cylinder (C) and of the needle-holding plate (P), so that the needles (N2) of the plate (P) make a delayed stitch in cooperation with the needles (N1) of the cylinder (C); and an advanced operating position, which is angularly before with respect to the synchronous operating position, with respect to the direction of rotation of the cylinder (C) and of the needle-holding plate (P), in which the at least one stitch cam (10) causes a movement of the needles (N2) of the plate (P) during the stitch formation, which is angularly advanced with respect to the movement of the underlying needles (N1) of the cylinder (C), during the rotation of the needle-holding cylinder and of the needle-holding plate (P), so that the needles (N2) of the plate (P) make an advanced stitch in cooperation with the needles (N1) of the cylinder (C), and/or wherein the synchronous operating position corresponds to said first operating position and the delayed operating position or the advanced operating position corresponds to said second operating position.

8. The circular knitting machine (1) according to claim 7, wherein the delayed operating position and the advanced operating position are positions in which the at least one stitch cam (10) causes an offset, during the stitch formation, of the plate needles (N2) with respect to the cylinder needles (N1), or wherein the advanced operating position corresponds to said first operating position and the delayed operating position corresponds to said second operating position, the synchronous operating position resulting from a third intermediate operating position between said first operating position and said second operating position, and/or wherein said first and said second angular positions are end angular positions that can be reached by the at least one stitch cam (10) in the movement of the at least one stitch cam (10) along said circular trajectory thanks to said moving device (20).

9. The circular knitting machine (1) according to claim 7, wherein the moving device (20) operatively acts upon the at least one stitch cam (10) so as to move the at least one stitch cam (10) selectively and continuously among the plurality of operating positions, each one being characterized by a determined angular positioning of the at least one stitch cam (10) with respect to the axis of rotation (X), along said circular trajectory, and wherein the variation of the angular position of the at least one stitch cam (10) occurs continuously among successive adjacent positions, and/or wherein the at least one stitch cam (10) can be moved continuously among the plurality of operating positions so as to introduce an incremental offset on working trajectories of the plate needles (N2) with respect to respective working trajectories of the cylinder needles (N1), and/or wherein the at least one stitch cam (10) has a given angular extension around the axis of rotation (X), so as to engage a given portion of a rotation trajectory of a needle of the plurality of plate needles (N2), and/or wherein a width of angular rotation of the at least one stitch cam (10) is of at least 2°, or of at least 4°, or of at least 12°, or of at least 20°.

10. The circular knitting machine (1) according to claim 9, wherein said moving device (20) is integral with said supporting ring (4) of the dial assembly (3), and wherein the moving device (20) comprises a motor (21) operatively acting upon said at least one stitch cam (10) so as to selectively move the at least one stitch cam (10) between the plurality of operating positions, and/or wherein the moving device (20) comprises a plate (22) at least provided with:

a mounting fulcrum through which the plate (22) of the moving device (20) is turnably mounted to said supporting ring coaxially to said axis of rotation (X);

a fastening portion (24) destined to receive the at least one stitch cam (10) so as to support and position the at least one stitch cam (10) in said plurality of operating positions;

a control portion (25) configured for receiving a motion from said motor (21), so as to cause a rotation of the plate (22) of the moving device (20) around the axis of rotation (X) and a corresponding rotation of said fastening portion (24), carrying the at least one stitch cam (10), along the aforesaid circular trajectory, the plate being operatively placed between said at least one stitch cam (10) and said motor (21).

11. The circular knitting machine (1) according to claim 10, wherein the control portion (25) comprises a toothed sector (26), and wherein the moving device (20) comprises a drive shaft (27) coupled with the motor (21) so as to receive from the motor (21) a rotary motion and ending at a final end thereof with a toothed gear (30) engaged with said toothed sector (26) of the control portion (25), so as to transmit the rotary motion of the drive shaft to the plate (22) of the moving device (20), and/or wherein the at least one stitch cam (10) is in contact, beyond the rotating plate needles (N2), with said plate (22) of the moving device (20) only, and/or wherein the control portion (25) is placed in the plate (22) of the moving device (20) in a diametrically opposed position with respect to the fastening portion (24) for the at least one stitch cam (10), and/or wherein said toothed sector (26) has such an extension as to enable a respective width of angular rotation of the plate (22) of the moving device (20) that can position the at least one stitch cam (10) in all of the plurality of operating positions.

12. The circular knitting machine (1) according to claim 10, wherein the needle-holding cylinder (C) comprises at least one respective stitch cam, configured for interacting with the cylinder needles (N1) in a given angular sector during the rotation of the needle-holding cylinder (C) around the axis of rotation (X), said at least one respective stitch cam being configured for transmitting to the cylinder needles (N1) a return motion, into the respective sliding seat (2), in a determined angular position so as to execute stitch formation, and wherein the needle-holding cylinder (C) comprises a respective moving device, operatively acting upon the at least one respective stitch cam of the cylinder (C) so as to move the at least one respective stitch cam between at least one respective first operation position, in which the at least one respective stitch cam of the cylinder (C) takes a first position, with respect to a respective first operating position of the cylinder (C) on which the sliding seats (2) of the cylinder needles (N1) are defined, and one respective second operating position, in which the at least one respective stitch cam of the cylinder (C) takes a second position, with respect to the respective first operating position of the cylinder (C), which is different—angularly and/or in height—from said respective first operating position, wherein the respective moving device for moving the at least one respective stitch cam of the needle-holding cylinder (C) comprises a respective motor, operatively acting upon the at least one respective stitch cam of the cylinder (C) so as to selectively move the at least one respective stitch cam among the respective first and respective second operating positions, and wherein the knitting machine comprises a control unit configured for interacting with the moving device (20) of the dial assembly (3) and with the respective moving device moving the stitch cam of the needle-holding cylinder (C), so as to:

receive a first position signal from the motor (21) acting upon the at least one stitch cam (10) of the needle-holding plate (P), said first position signal being related to a position of the at least one plate stitch cam (10);

receive a second position signal from the respective motor acting upon the at least one respective stitch cam of the needle-holding cylinder (C), said second position signal being related to a position of the cylinder stitch cam;

selectively control the motor (21) acting upon the at least one stitch cam (10) of the needle-holding plate (P) and the respective motor acting upon the at least one respective stitch cam of the needle-holding cylinder (C) so that the position of the at least plate stitch cam (10) and the position of the at least one respective cylinder stitch cam coincide with respective reference values.

13. The circular knitting machine (1) according to claim 12, wherein the control unit is configured for programming and/or maintaining a given offset between the position of the at least one stitch cam (10) of the needle-holding plate (P) and the position of the at least one respective stitch cam of the needle-holding cylinder (C), based on the first and second position signals of the motor (21) acting upon the at least one stitch cam (10) of the needle-holding plate (P) and of the respective motor acting upon the at least one respective stitch cam of the needle-holding cylinder (C) respectively, and suitably controlling the position of both motors, and/or wherein the control unit is configured for making a feedback check of the positions of the at least one stitch cam (10) of the needle-holding plate (P) and of the at least one respective stitch cam of the needle-holding cylinder (C) by changing in a dynamic and continuous manner a position of the motor (21) acting upon the at least one stitch cam (10) of the needle-holding plate (P) and e position of the respective motor acting upon the at least one respective stitch cam of the needle-holding cylinder (C) based on the first and second position signals of both motors, so as to maintain a mutual positioning between the at least one stitch cam (10) of the needle-holding plate (P) and the at least one respective stitch cam of the needle-holding cylinder (C).

14. The circular knitting machine (1) according to claim 12, wherein the moving device (20) comprises at least one proximity sensor (40) placed in the dial assembly (3) and configured for detecting a presence or absence of a reference element placed on said at least one stitch cam (10) or on said plate (22) of the moving device (20) carrying the at least one stitch cam (10), in a given reference position, and wherein said given reference position is selected so that the position taken by the at least one stitch cam (10) when the proximity sensor (40) detects the presence of the reference element corresponds to a given condition of mutual positioning between the at least one stitch cam of the needle-holding plate (P) and the at least one respective stitch cam of the needle-holding cylinder (C).

15. The circular knitting machine (1) according to claim 14, wherein the position taken by the at least one plate stitch cam (10) in said given condition of mutual positioning between the at least one plate stitch cam (10) and the at least one respective cylinder stitch cam can correspond to the synchronous operating position, or to the advanced operating position, or to the delayed operating position, or to a different operating position, belonging to said plurality of operating positions, of the at least one plate stitch cam (10), and/or wherein said control unit is configured for executing a calibration of the motor (21) acting upon the at least one stitch cam (10), by executing the following operations:

moving, by said moving device (20), the at least one stitch cam (10) until the at least one proximity sensor (40) detects the presence of said reference element;

verify whether a deviation between the value of said first position signal of the motor (21) acting upon the at least one plate stitch cam (10) and a default value falls within a tolerance interval for considering 9 a position of the motor (21) as correct;

actuate the motor (21) acting upon the at least one stitch cam (10) of the needle-holding plate (P) so as to reset or minimize said deviation between the value of said first position signal and said default value.

16. The circular knitting machine (1) according claim 15, wherein the control unit is configured for executing an automatic check of the calibration of the motor (21) acting upon the at least one stitch cam (10), resetting at every stitch formation cycle or as a result of calibration commanding the position of the motor (21) acting upon the at least one plate stitch cam (10) so that there is no deviation between the value of the first position signal and said default value, the resetting occurring only if the deviation of the value of the first position signal and the default value falls within said tolerance interval;

and/or wherein the at least one proximity sensor (40) is integral with or mounted to said supporting ring, and/or wherein the at least one proximity sensor (40) is of inductive or capacitive or magnetic or ultrasonic or optical type.

* * * * *